US006170962B1

(12) United States Patent
Wordin

(10) Patent No.: US 6,170,962 B1
(45) Date of Patent: Jan. 9, 2001

(54) DUAL COMPOUND REFLECTOR FOR FLUORESCENT LIGHT FIXTURES

(76) Inventor: John Joseph Wordin, 735 N. 900 East, Shelley, ID (US) 83274

( * ) Notice: Under 35 U.S.C. 154(b), the term of this patent shall be extended for 0 days.

(21) Appl. No.: 09/436,814

(22) Filed: Nov. 9, 1999

Related U.S. Application Data

(63) Continuation-in-part of application No. 08/746,548, filed on Nov. 13, 1996, now Pat. No. 6,007,220.

(51) Int. Cl.[7] ..... F21V 7/00

(52) U.S. Cl. ..... 362/247; 362/304; 362/346; 362/347; 362/260

(58) Field of Search ..... 362/260, 297, 362/304, 346, 347, 296, 247

(56) References Cited

U.S. PATENT DOCUMENTS

| | | | | |
|---|---|---|---|---|
| 3,492,474 | | 1/1970 | Yamaguchi et al. . | |
| 4,089,047 | * | 5/1978 | Luderitz | 362/297 |
| 4,295,186 | | 10/1981 | Sugiura et al. . | |
| 4,683,526 | * | 7/1987 | Krogsrud et al. | 362/346 |
| 4,868,727 | | 9/1989 | Ponds et al. . | |
| 5,136,491 | * | 8/1992 | Kano | 362/346 |
| 6,007,220 | * | 12/1999 | Wordin | 362/296 |

OTHER PUBLICATIONS

Handbook: Illumination Society of America.
Mark's Standard Handbook for Mechanical Engineers, 8th Edition, 1979.

* cited by examiner

*Primary Examiner*—Stephen Husar

(57) ABSTRACT

A specular dual compound reflector having a cross section in the form of hyperbolas is disclosed. This reflector is combined with energy saving fluorescent tubes and ballast, forming a fluorescent light fixture for the purpose of providing adequate and uniform illumination to a surface, subdue shadows, provide agreeable illumination, and resulting in substantial energy savings. Two similar configurations are disclosed.

4 Claims, 2 Drawing Sheets

DUAL COMPOUND REFLECTOR FOR FLUORESCENT LIGHT FIXTURES

CROSS-REFERENCE TO RELATED APPLICATIONS

This is a continuation-in-part of patent application Ser. No. 08/746,548, filed Nov. 13, 1996, now U.S. Pat. No. 6,007,220.

REFERENCES

1. U.S. Pat. No. 4,089,047 "Trifocal Mirror-Reflector" to Luderitz, May 9, 1978
2. U.S. Pat. No. 4,683,526 "Asymmetric Lamp" to Krogsrad and Jul. 28, 1987
3. U.S. Pat. No. 4,868,727 "Light Fixture With Integral Reflector and Socket Shield" to Ponds and Calloway, Sep. 19, 1989
4. U.S. Pat. No. 4,295,186 "Slit Illuminating Device" Sugiura, Muneharu; Sagara, Seiji, Oct. 13, 1981
5. U.S. Pat. No. 3,492,474 "Reflector With Compound Curvature Reflecting Surface" Yamaguchi, Seiichi; Hishinuma, Satoshi, Jan. 27, 1970
6. Illumination Engineer's Association Handbook

BACKGROUND OF THE INVENTION

1. Field of the Invention

This invention is an article of manufacture and relates to reflectors, specifically, to a symmetrical reflector in the cross-sectional shape using two hyperbolas and fluorescent light fixtures utilizing such a reflector.

2. Description of Related Art

Other patents have taught how to use reflectors on light fixtures that have a cross-sectional shape generally hyperbolic, generally elliptic, or generally parabolic. For example, Reference 1 uses reflectors with elliptical cross-sections with the feature of one set of foci of the ellipses being coincident and with the other foci located at the ceiling level. These incandescent light fixtures use only reflected light with the embodiment designed such that all direct light coming from the light source is blocked. This patent would restrict the fixture to something small in diameter in order to meet the requirement of having one set of foci coincident. Having all direct light blocked seriously limits the efficiency of the lamp. A hyperbolic reflection surface is added to the lamp in another embodiment that is described, however, no diagram of the configuration is provided and the juxtaposition of the light source and the focus of the hyperbola is not taught.

Reference 2 claims a desk lamp with a reflector in the shape of a parabola formed from a series of triangular facets. This patent claims a method to approximately construct at reasonable cost, a curved reflection surface to improve the light delivery from the lamp.

Reference 3 claims a reflector, curvilinear in cross-sectional shape, and having tabs formed from part of the reflector surface for the purpose of socket protectors. The relative location of the light bulb to the reflector is not taught. Many other necessary features to define the embodiment of the reflector, such as the position of the light bulb relative to the focus of a conic section, is not taught. This embodiment utilizes a 300-watt light bulb, and therefore is not designed for energy savings but as a security lighting fixture.

Reference 4 is a lighting device having a plurality of linear surface mirrors, each partially surrounding a single light source. The reflector approximates an elliptical-shaped reflector. Its purpose is for use in a reproduction machine.

Reference 5 is a three-dimensional concavo-convex reflector for use as a headlamp on an automobile. At least part of the three-dimensional surface is formed having a hyperbolic curvature in the horizontal plane. It has a single light source. No attempt is made to provide energy savings.

Although there are a number of fluorescent light fixtures on the market, few seem to utilize the direct light and reflected light coming from the light source to full advantage. Reflection surfaces are painted milky white that has a medium reflectance. Some reflectors are being made on special order to retrofit existing light fixtures, reduce the number of fluorescent tubes, and thus improve the light efficiency and energy utilization. These retrofit reflectors are fabricated by bending them into rectangular facets thus approximating a parabola in cross-sectional shape. A highly reflective material, such as Silverlux by 3M Company applied to the surface of a thin aluminum sheet, is being used as the material for these reflectors. Since a parabolic reflector directs the light straight downward, the area of illumination between the rows of fixtures is lit only by direct light and receives very little of the reflected light. These installations tend to have a bright area under the fixture and a shadowy, dark area half way between fixtures. This non-uniform distribution of light is objectionable.

Generally, fluorescent light fixtures, which are designed to provide illumination for an area, should:

a. Provide an adequate level of illumination.

b. Uniformly illuminate the area.

c. Minimize the formation of shadows.

d. Provide light agreeable for human activity.

e. Minimize the use of energy while providing an adequate level of illumination.

None of the above mentioned embodiments meet all five of these criteria. Accordingly, there is a need for new, optimized, efficient fluorescent light fixtures that will provide uniform light patterns coupled with an adequate level of illumination, and providing substantial energy savings. They must be suitable for use in new building construction or retrofit to existing structures, for illumination of art works or advertising signs, and for use in homes, stores, and offices.

OBJECTS AND ADVANTAGES

Modern civilization has moved indoors and functions around the clock. Thus, there is a need for low cost lighting in buildings, offices, warehouses, barns, museums, homes, and where ever there is human activity. Electrical rates continue to slowly rise and, as a strategy to cope with these rate increases, conservation is one approach. Because much human activity takes place indoors under artificial light, the light level must be high enough so quality work can be conducted, sporting events well lit, and kitchen areas adequately lit for food preparation. Shadows produced by point sources of light are a nuisance. Similarly, uneven lighting in work areas creates eyestrain. Uneven lighting of advertising displays sacrifices impact. Light and dark areas on paintings or tapestries on exhibit in art museums detracts from the presentation of such artistic works.

Approximately 80% of what human beings learn comes through the sense of sight. Human beings see objects by reflected light. Therefore, it is important that human factors of illumination in a room, office, or other work place, be bright, have good color rendition, and exhibit a character and quality which is most pleasing and agreeable.

Accordingly, it is an object of this invention to provide an occupied area with fluorescent light fixtures which provide an adequate level of illumination while substantially saving energy compared to existing light fixtures. In addition, another object of this invention is to minimize or eliminate shadows and to provide an illuminated area that is lighted in a uniform manner. It is a further object of this invention to provide illumination to an area by light fixtures projecting light that has a most pleasing character and quality.

BRIEF SUMMARY OF THE INVENTION

The law of reflection is the essential physical principle upon which this invention is based. It states:

> When an energy wave incident upon a flat or curved surface is reflected, the angles of incidence and of reflection are equal and lie in the same plane.

Various materials and types of surfaces reflect light at a different reflectance. A diffuse surface can reflect 10% to 60% of incident light while a specular surface can reflect 80% to 95% of the incident light. Since high efficiency is desired to achieve energy savings, the surface finish chosen for the reflector is specular. Polished aluminum, polished stainless steel, and a plastic laminate called Silverlux by 3M Company all qualify as possible candidates for reflector surfaces. Material selection for the reflector surface is not limited to this list of materials, others surely also qualify.

A second ingredient needed is the shape of the reflector. The classic shape used in the past for light fixtures with reflectors has been the parabola that is know to reflect the light downward. For this current invention, a hyperbola in a 2-dimensional shape is selected for the reflector. Reference 6 shows the general principle of the use of a hyperbola as a reflector but does not show any embodiment. This cross-sectional shape is selected because the hyperbolic reflector provides a broad diffusing light pattern on the illuminated surface by reflecting the light downward and outward. The axis of the hyperbola can be angled in order to throw the light in a downward and outward direction also. Much of the light from the backside of the fluorescent tube is reflected to a surface that is to be illuminated. Thus, an illuminated surface receives the direct light from the fluorescent tubes plus the light reflected from the reflector.

When a reflector in the shape of a hyperbola is located behind a fluorescent light tube as a light source, and the center of the light source is located coincident with the primary focus of the hyperbola, the reflected light appears to have originated from the other focus, herein referred to as the virtual focus, of the hyperbola. The virtual focus is associated with the unused branch of the hyperbola. It can be shown by mathematical development that the hyperbola precisely matches the law of reflection and can demonstrate the feature of the hyperbolic reflector that the reflected light appears to originate from the virtual focus. See FIG. 1. In this case the pencil of light rays appear as a fan-shape providing a natural diffusion pattern of reflected light emanating from the virtual focus. Thus, the direct light is a fan of light rays from the primary focus and the reflected light is a fan of light rays from the virtual focus. This dual set of light sources, one above the other, tends to eliminate shadows from objects placed near the light fixture.

The current invention has two fluorescent tubes. Associated with each fluorescent tube is a reflector section in a hyperbolic shape, one reflector section being the mirror image of the other reflector section, where the reflector sections are joined at the centerline at a common edge so the reflector is symmetrical. The common edge is located below a straight line connecting the two primary foci. The central part of the reflector is constructed so as to interrupt the light that would otherwise be directed from one tube to the other, and reflects this light emanating from each fluorescent tube toward the surface to be illuminated. By having the fixture constructed in this arrangement with direct light coming from the two primary foci and reflected light seeming to come from the two virtual foci provides agreeable light uniformly distributed on the surface to be illuminated. This combination also provides for adequate levels of illumination.

As a variation, it is possible to design the light fixture so that the two virtual foci are coincident. In this alternate embodiment, all the reflected light from both the reflector sections seems to come from the coincident virtual foci.

Light fixtures using the reflectors described above, combined with energy-saving fluorescent tubes and electronic ballasts, results in substantial energy savings compared to currently available fluorescent light fixtures while providing an adequate level of illumination. This is achieved by overall improvement in efficiency of the light delivery by the hyperbolically shaped specular reflector and the need for fewer electronic components.

DETAILED DESCRIPTION OF THE INVENTION

Figure 1:
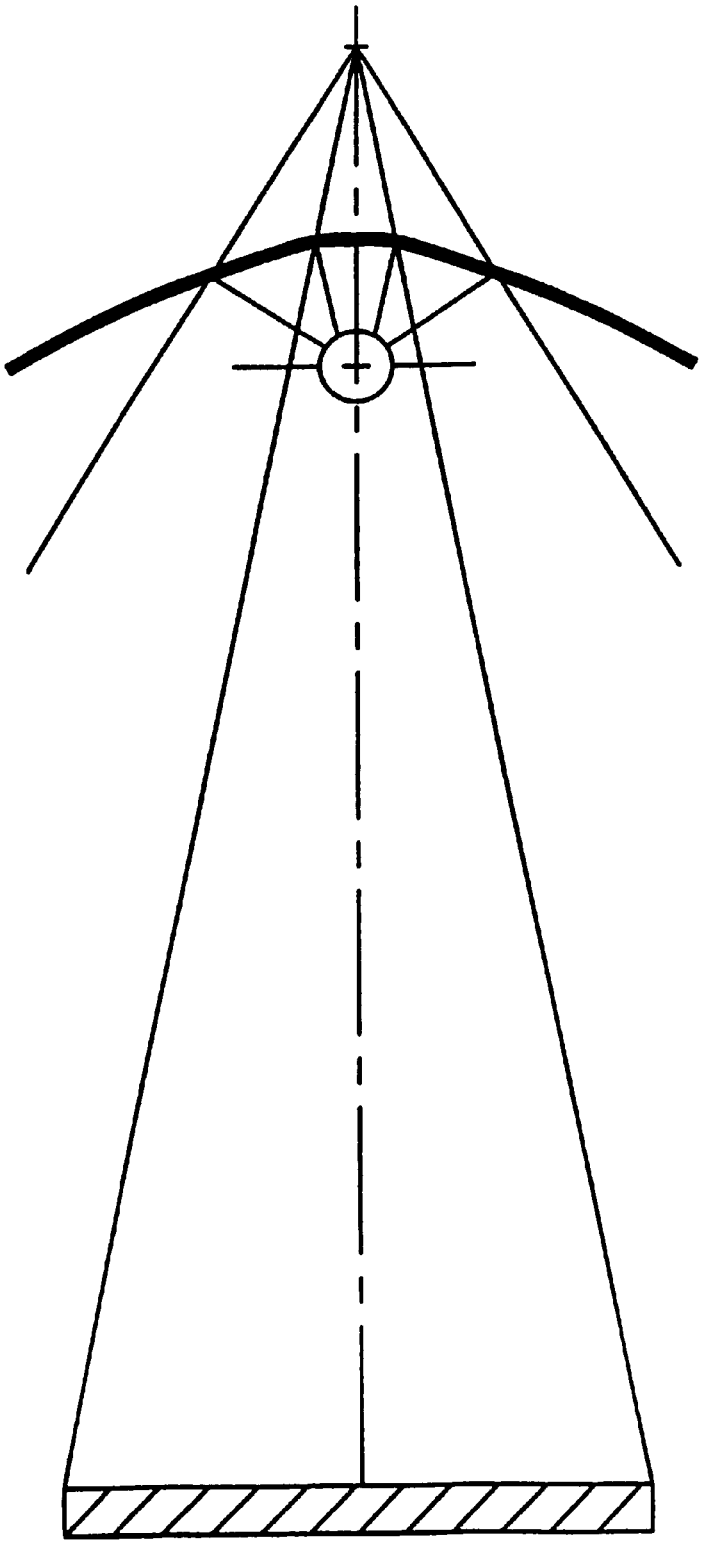
PRIOR ART FIGURE 1
FIG. 1 is a general view of reflected light from a hyperbolic reflector.
Figure 2:
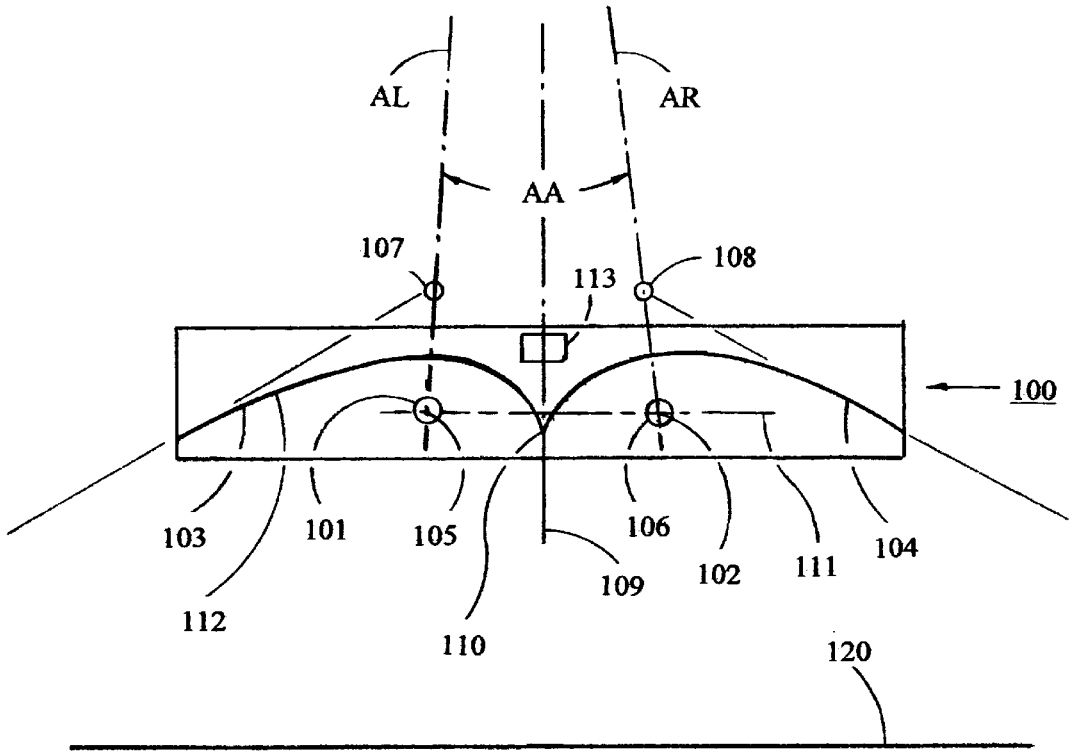
FIG. 2 shows a symmetrical fluorescent light fixture with two fluorescent tubes where the reflectors are hyperbolic cross-sectional shaped specular reflectors. The non-parallel axes of the reflectors are canted to reflect the light downward and outward.

The preferred embodiment for this invention is shown in FIG. 2, where a fluorescent light fixture with two connected hyperbolic cross-sectional specular reflector shapes is presented. The axes associated with the hyperbolic reflectors are not parallel.

FIG. 2 presents a light fixture 100, using two fluorescent light sources 101 and 102 as the preferred embodiment for light fixtures requiring two elongated light sources. Associated with light source 101 is a hyperbolic shaped first reflector section 103 and associated with light source 102 is a hyperbolic shaped second reflector section 104. Second reflector section 104 is a mirror image of the first reflector section 103. First reflector section 103 has associated with it a first primary focus 105 and a first virtual focus 107. Second reflector section 104 has associated with it a second primary focus 106 and a second virtual focus 108. The center of the light source 101 is located coincident with the first primary focus 105 and the center of light source 102 is located coincident with second primary focus 106. Straight line 111 is constructed by connecting the first primary focus 105 with the second primary focus 106. Common edge 110 is located below and on the opposite side of straight line 111 from the fluorescent light sources 101 and 102. The reflector so formed by joining the first reflector section 103 and the second reflector section 104 at the centerline 109 along a common edge 110, is termed a dual compound reflector 112.

Each reflector section 103 and 104 has an axis, first axis AL on the left for the first reflector section 103, and a second axis AR on the right for the second reflector section 104. Axis AL is defined as a straight line connecting the first primary focus 105 and the first virtual focus 107. Axis AR is defined by a straight line connecting the second primary focus 106 and the second virtual focus 108. First virtual focus 107 and second virtual focus 108 are generally located above the fixture. Axes AL and AR will generally be angled a few degrees relative to the centerline of the fixture such that the axes are nonparallel. The acute angle forming between axis AL and axis AR is termed angle AA.

Each fluorescent light fixture must have a ballast 113, which is generally located above the reflector and within the fixture, and associated wiring from the ballast to the tubes according to the known art. A translucent cover (not shown) may be added to the fixture. Light fixture 100 comprising the two fluorescent light sources, ballast, wiring, and the dual compound reflector 112 provides illumination to surface 120.

Figure 3:
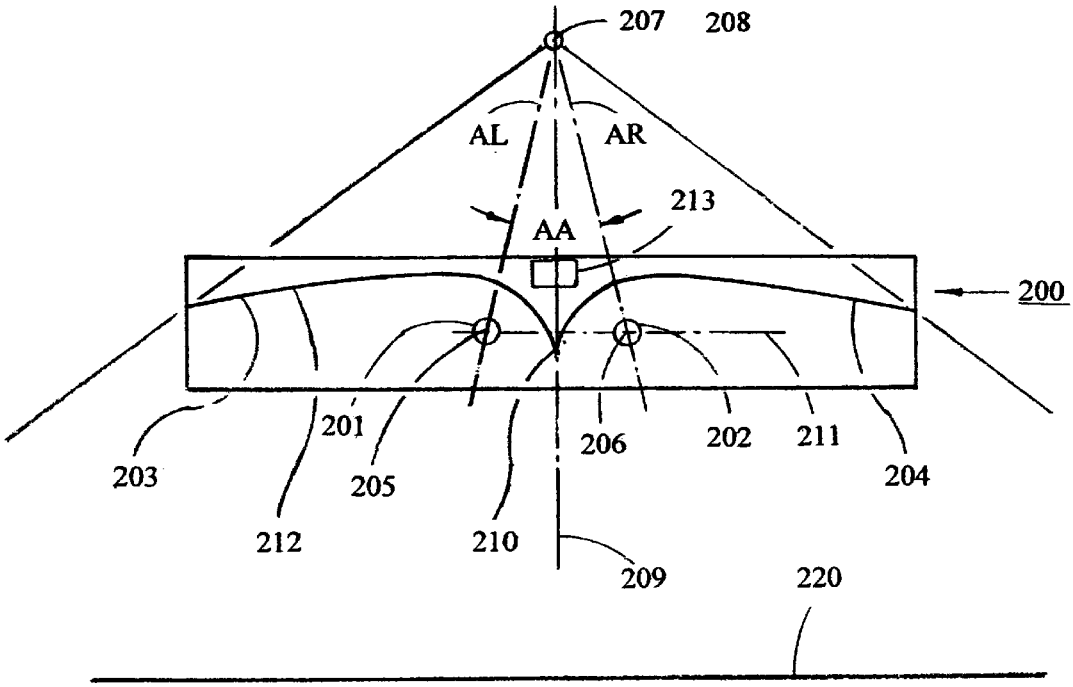
FIG. 3 shows a symmetrical fluorescent light fixture with two fluorescent tubes where the reflectors are hyperbolic cross-sectional shaped specular reflectors. In this alternate embodiment, the two virtual foci are coincident.

FIG. 3 presents a light fixture 200, using two elongated fluorescent light sources 201 and 202 as an alternate embodiment for light fixtures requiring two elongated light sources employing a dual compound hyperbolic reflector. Associated with light source 201 is a hyperbolic shaped first reflector section 203 and associated with light source 202 is a hyperbolic shaped second reflector section 204. Second reflector section 204 is a mirror image of the first reflector section 203. First reflector section 203 has associated with it a first primary focus 205 and a first virtual focus 207. Second reflector section 204 has associated with it a second primary focus 206 and a second virtual focus 208. The center of the fluorescent light source 201 is located coincident with the first primary focus 205 and the center of fluorescent light source 202. is located coincident with second primary focus 206. Straight line 211 is constructed by connecting the first primary focus 205 with the second primary focus 206. Common edge 210 is located below and on the opposite side of straight line 211 from the light sources 201 and 202. The reflector so formed by joining the first reflector section and the second reflector section at the centerline 209 along a common edge 210 is termed a dual compound reflector 212.

Each reflector section 203 and 204 has an axis, first axis AL on the left for the first reflector section 203, and a second axis AR on the right for the second reflector section 204. Axis AL is defined as a straight line connecting the first primary focus 205 and the first virtual focus 207. Axis AR is defined by a straight line connecting the second primary focus 206 and the second virtual focus 208. First virtual focus 207 and second virtual focus 208 are generally located above the fixture and are coincident. The acute angle forming between axis AL and axis AR is termed angle AA.

Each fluorescent light fixture must have a ballast 213, which is generally located above the reflector and within the fixture, and provided with associated wiring from the ballast to the tubes according to the known art. A translucent cover (not shown) may be added to the light fixture. Light fixture 200 comprising the two light sources, ballast, wiring, and the dual compound reflector 212 with coincident virtual foci provides illumination to surface 220.

The foregoing description of the invention has been presented for purposes of illustration and description. It is not intended to be exhaustive or to limit the invention to the precise form disclosed. Obvious modifications or variations are possible in light of the above teachings.

The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims, which are appended.

GLOSSARY

FIG. 2
100 fluorescent light fixture
101 first fluorescent light source
102 second fluorescent light source
103 first reflector section
104 second reflector section
105 first primary focus
106 second primary focus
107 first virtual focus
108 second virtual focus
109 centerline of the light fixture, an axis of symmetry
110 common edge connecting first reflector section and the second reflector section
111 line-of-sight straight line defined by connecting the first primary focus with the second primary focus
112 dual compound reflector
113 ballast
120 illuminated surface
AR first axis
AL second axis
AA angle formed between axis AL and axis AR
FIG. 3
200 fluorescent light fixture
201 first fluorescent light source
202 second fluorescent light source
203 first reflector section
204 second reflector section
205 first primary focus
206 second primary focus
207 first virtual focus
208 second virtual focus
209 centerline of the light fixture, an axis of symmetry
210 common edge connecting first reflector section and the second reflector section
211 line-of-sight straight line defined by connecting the first primary focus with the second primary focus
212 dual compound reflector with coincident virtual foci
213 ballast
220 illuminated surface
AR first axis
AL second axis
AA angle formed between axis AL and axis AR

What is claimed is:

1. A symmetrical dual compound reflector having a cross section, which cross-section comprising:

a first reflector section forming along a curve of a first hyperbola, said first reflector section having a first primary focus and a first virtual focus, and having a first axis defined by a straight line connecting said first primary focus and said first virtual focus;

a second reflector section forming along a curve of a second hyperbola, said second reflector section having a second primary focus and a second virtual focus, and having a second axis defined by a straight line connecting said second primary focus and said second virtual focus;

said first axis and said second axis are nonparallel to said line of symmetry and forming an acute angle;

said first reflector section and said second reflector section joining at a common edge coincident with a line of symmetry and with said common edge located below a straight line connecting said first primary focus and said second primary focus.

2. The symmetrical dual compound reflector of claim 1 wherein said reflector combining with two fluorescent tubes, each co-located and coincident with said first primary focus and said second primary focus of said symmetrical dual compound reflector, forming a fluorescent light fixture for the purpose of illuminating a surface.

3. A symmetrical dual compound reflector having a cross section, which cross-section comprising:

a first reflector section forming along a curve of a first hyperbola, said first reflector section having a first primary focus and a first virtual focus, and having a first axis defined by a straight line connecting said first primary focus and said first virtual focus;

a second reflector section forming along a curve of a second hyperbola, said second reflector section having a second primary focus and a second virtual focus, and having a second axis defined by a straight line connecting said second primary focus and said second virtual focus;

said first axis and said second axis are nonparallel to said line of symmetry and forming an acute angle such that said first virtual focus and said second virtual focus are coincident;

said first reflector section and said second reflector section joining at a common edge coincident with a line of symmetry and with said common edge located below a straight line connecting said first primary focus and said second primary focus.

4. The symmetrical dual compound reflector with coincident virtual foci of claim 3 wherein said reflector combining with two fluorescent tubes, each co-located and coincident with said first primary focus and said second primary focus of said symmetrical dual compound reflector, forming a fluorescent light fixture for the purpose of illuminating a surface.

* * * * *